US009387661B2

(12) United States Patent
Zirilli

(10) Patent No.: US 9,387,661 B2
(45) Date of Patent: Jul. 12, 2016

(54) DAMPENING FLUID VAPOR DEPOSITION SYSTEMS FOR INK-BASED DIGITAL PRINTING

(71) Applicant: XEROX CORPORATION, Norwalk, CT (US)

(72) Inventor: Francisco Zirilli, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/340,055

(22) Filed: Jul. 24, 2014

(65) Prior Publication Data

US 2016/0023452 A1 Jan. 28, 2016

(51) Int. Cl.
*B41F 7/32* (2006.01)

(52) U.S. Cl.
CPC ..... *B41F 7/32* (2013.01)

(58) Field of Classification Search
CPC ..... B41F 3/32; B41F 7/32; B41F 7/37; B41F 33/0054; B41N 3/006; B41C 1/1041; B41P 2227/70; B41L 25/12
See application file for complete search history.

(56) References Cited

U.S. PATENT DOCUMENTS

| | | | | |
|---|---|---|---|---|
| 4,881,661 | A * | 11/1989 | Jones | 222/67 |
| 8,991,310 | B2 * | 3/2015 | Stowe et al. | 101/147 |
| 9,019,329 | B2 * | 4/2015 | Zirilli et al. | 347/224 |
| 9,032,874 | B2 * | 5/2015 | Liu et al. | 101/147 |
| 2012/0103212 | A1 | 5/2012 | Stowe et al. | |
| 2012/0304878 | A1 * | 12/2012 | Zhang et al. | 101/177 |
| 2013/0033686 | A1 * | 2/2013 | Stowe et al. | 355/30 |
| 2014/0261030 | A1 * | 9/2014 | Liu et al. | 101/147 |

* cited by examiner

*Primary Examiner* — Matthew G Marini
*Assistant Examiner* — Leo T Hinze
(74) *Attorney, Agent, or Firm* — Ronald E. Prass, Jr.; Prass LLP

(57) ABSTRACT

An ink-based digital printing dampening fluid delivery system useful for printing with an ink-based digital printing system, the ink-based digital printing system having an imaging member, includes a supply chamber; and a supply channel, the supply channel being configured to deliver fluid onto a surface of the imaging member, wherein a width of the surface of the imaging member onto which dampening fluid is applied is twenty percent greater, or more, than a diameter of the supply chamber.

8 Claims, 10 Drawing Sheets

DAMPENING FLUID VAPOR DEPOSITION SYSTEMS FOR INK-BASED DIGITAL PRINTING

FIELD OF DISCLOSURE

The disclosure relates to ink-based digital printing. In particular, the disclosure relates to printing variable data using an ink-based digital printing system that includes a dampening fluid vapor deposition system for enhanced dampening fluid delivery.

BACKGROUND

Conventional lithographic printing techniques cannot accommodate true high-speed variable data printing processes in which images to be printed change from impression to impression, for example, as enabled by digital printing systems. The lithography process is often relied upon, however, because it provides very high quality printing due to the quality and color gamut of the inks used. Lithographic inks are also less expensive than other inks, toners, and many other types of printing or marking materials.

Ink-based digital printing uses a variable data lithography printing system, or digital offset printing system. A "variable data lithography system" is a system that is configured for lithographic printing using lithographic inks and based on digital image data, which may be variable from one image to the next. "Variable data lithography printing," or "digital ink-based printing," or "digital offset printing" is lithographic printing of variable image data for producing images on a substrate that are changeable with each subsequent rendering of an image on the substrate in an image forming process.

For example, a digital offset printing process may include transferring radiation-curable ink onto a portion of a fluorosilicone-containing imaging member surface that has been selectively coated with a dampening fluid layer according to variable image data. The ink is then cured and transferred from the printing plate to a substrate such as paper, plastic, or metal on which an image is being printed. The same portion of the imaging plate may be cleaned and used to make a succeeding image that is different than the preceding image, based on the variable image data. Ink-based digital printing systems are variable data lithography systems configured for digital lithographic printing that may include an imaging member having a reimageable surface layer, such as a silicone-containing surface layer.

Systems may include a dampening fluid metering system for applying dampening fluid to the reimageable surface layer, and an imaging system for laser-patterning the layer of dampening fluid according to image data. The dampening fluid layer is patterned by the imaging system to form a dampening fluid pattern on a surface of the imaging member based on variable data. The imaging member is then inked to form an ink image based on the dampening fluid pattern. The ink image may be partially cured, and is transferred to a printable medium, and the imaged surface of the imaging member from which the ink image is transferred is cleaned for forming a further image that may be different than the initial image, or based on different image data than the image data used to form the first image. Such systems are disclosed in U.S. patent application Ser. No. 13/095,714 ("714 Application"), published as US 2012/0103212, titled "Variable Data Lithography System," filed on Apr. 27, 2011, by Stowe et al., which is commonly assigned, and the disclosure of which is hereby incorporated by reference herein in its entirety.

SUMMARY

Variable data lithographic printing system and process designs must overcome substantial technical challenges to enable high quality, high speed printing. For example, digital architecture printing systems for printing with lithographic inks impose stringent requirements on subsystem materials, such as the surface of the imaging plate, ink used for developing an ink image, and dampening fluid or fountain.

Fountain solution or dampening fluid such as octamethylcyclotetrasiloxane "D4" or cyclopentasiloxane "D5" may be applied to an imaging member surface such as a printing plate or blanket. Subsequently, the applied layer of dampening fluid is image-wise vaporized according to image data to form a latent image in the dampening fluid layer, which may be about 0.5 microns in thickness, for example. During the laser imaging process, the base marking material layer is deposited in a uniform layer, and may spread across the background region, allowing subsequently applied ink to selectively adhere to the image region. A background region includes D4 between the plate and ink. A thickness of the dampening fluid layer is around 0.2 microns, or between 0.05 and 0.5 microns. The laser used to generate the latent image creates a localized high temperature region that is at about the boiling point of the dampening fluid, e.g., about 175° C. Accordingly, during the imaging process, large temperature gradients are formed on the imaging surface, and the surface temperature rapidly decreases to the ambient temperature away from the imaging zone, or the portion of the imaging member surface on which imaging takes place.

Due to a motion of the imaging member surface during printing, dampening fluid vapor has been found to migrate over cooler regions of the imaging member surface, allowing the vapor to re-condense on the imaging surface. If re-condensation occurs over an imaged region of the imaging member surface, streaks may appear in the printed image. Dampening fluid vapor must be removed before it re-condenses on the imaging member surface.

A thickness of a dampening fluid layer formed on an imaging member, and a variability of the thickness of the disposed layer over the imaging member or plate surface is critical to effective printing operations. To obtain a uniform dampening fluid layer thickness, plate surface conditions must be satisfied. For example, under suitable conditions, an imaging member surface may be characterized by uniform temperature, a concentration of the dampening fluid may be uniform, and a mixture velocity tangential to the imaging member or plate motion may be uniform.

Systems and methods are provided that enable uniform dampening fluid flow onto a surface of an imaging member or plate. In an embodiment, systems may include a manifold system. The manifold system may have an operating supply chamber diameter to printing area surface width ratio of less than 0.8. Mixed air and dampening fluid may be caused to flow through a main supply chamber, and may be discharged onto a 100 mm wide imaging member surface at an angle of less than 30 degrees, for example, with uniform dampening fluid concentration, uniform mixture velocity, and uniform temperature.

The mixture may be introduced onto the imaging member surface at an angle of less than 30 degrees to minimize impingement, thus allowing the incoming dampening fluid vapor mixture velocity to be tangential to the rotating plate, and in the same tangential direction as the rotating plate. As such, a speed of the plate may be maintained at, for example, 1000 mm/sec. A width of the imaging member surface or printing area may be widened by adjusting the manifold dimensions while maintaining a diameter to width ratio of less than 0.8.

In an embodiment, an ink-based digital printing dampening fluid delivery system useful for printing with an ink-based digital printing system, the ink-based digital printing system having an imaging member, may include a supply chamber; and a supply channel, the supply channel being configured to deliver fluid onto a surface of the imaging member.

Exemplary embodiments are described herein. It is envisioned, however, that any system that incorporates features of systems described herein are encompassed by the scope and spirit of the exemplary embodiments.

DETAILED DESCRIPTION

Figure 1:
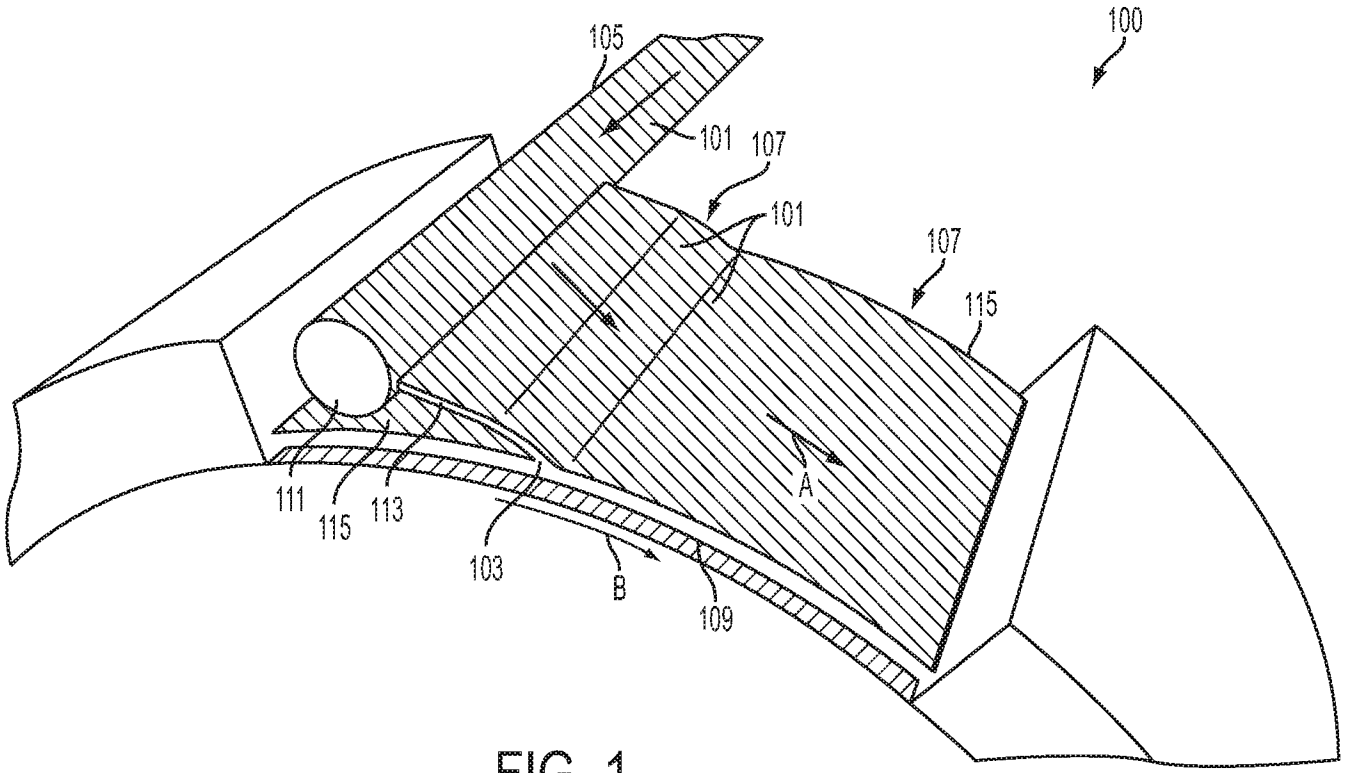
FIG. 1 shows a side diagrammatical view of a dampening fluid vapor deposition system in accordance with an exemplary embodiment.

Exemplary embodiments are intended to cover all alternatives, modifications, and equivalents as may be included within the spirit and scope of the apparatus and systems as described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Reference is made to the drawings to accommodate understanding of systems for ink-based digital printing, and ink-based digital printing system dampening fluid recovery systems. In the drawings, like reference numerals are used throughout to designate similar or identical elements. The drawings depict various embodiments of illustrative systems for depositing dampening fluid on a surface of an imaging member for ink-based digital printing.

In an embodiment, dampening fluid vapor deposition systems may include a supply manifold. The supply manifold may include a supply chamber. The supply manifold may include a supply channel. The supply channel may be configured to enable flow of dampening fluid from the supply chamber to the supply channel. In particular, the supply chamber may include an interior portion that contains dampening fluid. The supply chamber may be formed in a tube shape, for example, and may be configured to communicate with a dampening fluid supply for receiving dampening fluid.

The supply chamber may be constructed and configured to communicate with an interior of the supply chamber. The supply chamber may be configured to define an interior for containing dampening fluid, and may be connected to the supply chamber at a first end of the supply channel. An interior of the channel may communicate with a surface of an imaging member or plate in a printing system in which the dampening fluid deposition system is operably configured. Dampening fluid may be delivered to an interior of the supply chamber at a first end of the supply chamber. The dampening fluid may flow from the first end of the supply chamber to one or more openings 103 for communicating with a supply channel. The dampening fluid may flow from the supply chamber, through the supply channel, and out of the supply channel onto, for example, a surface of an imaging member.

FIG. 1 shows a dampening fluid vapor deposition system in accordance with an exemplary embodiment. In particular, FIG. 1 shows a vapor deposition system 100. The system 100 includes a dampening fluid manifold 101. The manifold 101 may include a supply chamber 105. The supply chamber 105 may be configured in the shape of a tube, for example. The supply chamber 105 may define an interior 111 for containing fluid such as dampening fluid suitable for ink-based digital lithographic printing.

The manifold 101 may include a supply channel 107. The supply channel 107 may define an interior 113. The interior 113 of the supply channel 107 may communicate with the interior 111 of the supply chamber 105 to enable flow of dampening fluid from the supply chamber 105 to the supply channel 107. The supply chamber 105 may be connected to a dampening fluid supply (not shown) for receiving dampening fluid in an interior of the supply chamber 105. Dampening fluid may be caused to flow in a direction of arrows A, through the supply chamber 105, to the supply channel 107, and through the supply channel 107 for depositing onto a surface of the imaging member 109, for example, at opening 103. The supply channel 107 extends to include arc walls 115 that continue adjacent the surface of the imaging member 109.

As shown in FIG. 1, the vapor deposition system 100 may be configured in an ink-based digital printing system for depositing dampening fluid on a surface of an imaging member or reimageable printing plate. In particular, the interior of the supply channel 107 may be configured to communicate with a surface of the imaging member or plate 109 to deliver dampening fluid vapor to the surface at an angle of 30 degrees or less, and in the same tangential direction as the rotating plate 109. As the surface of the imaging member 109 rotates in a process direction B, dampening fluid is caused to flow from the interior of the supply channel 107 to the surface of the imaging member 109. Preferably, a ratio of the cross sectional area of the supply channel 107 to the cross sectional area of the tubular supply chamber 105 is 0.8.

Figure 2:
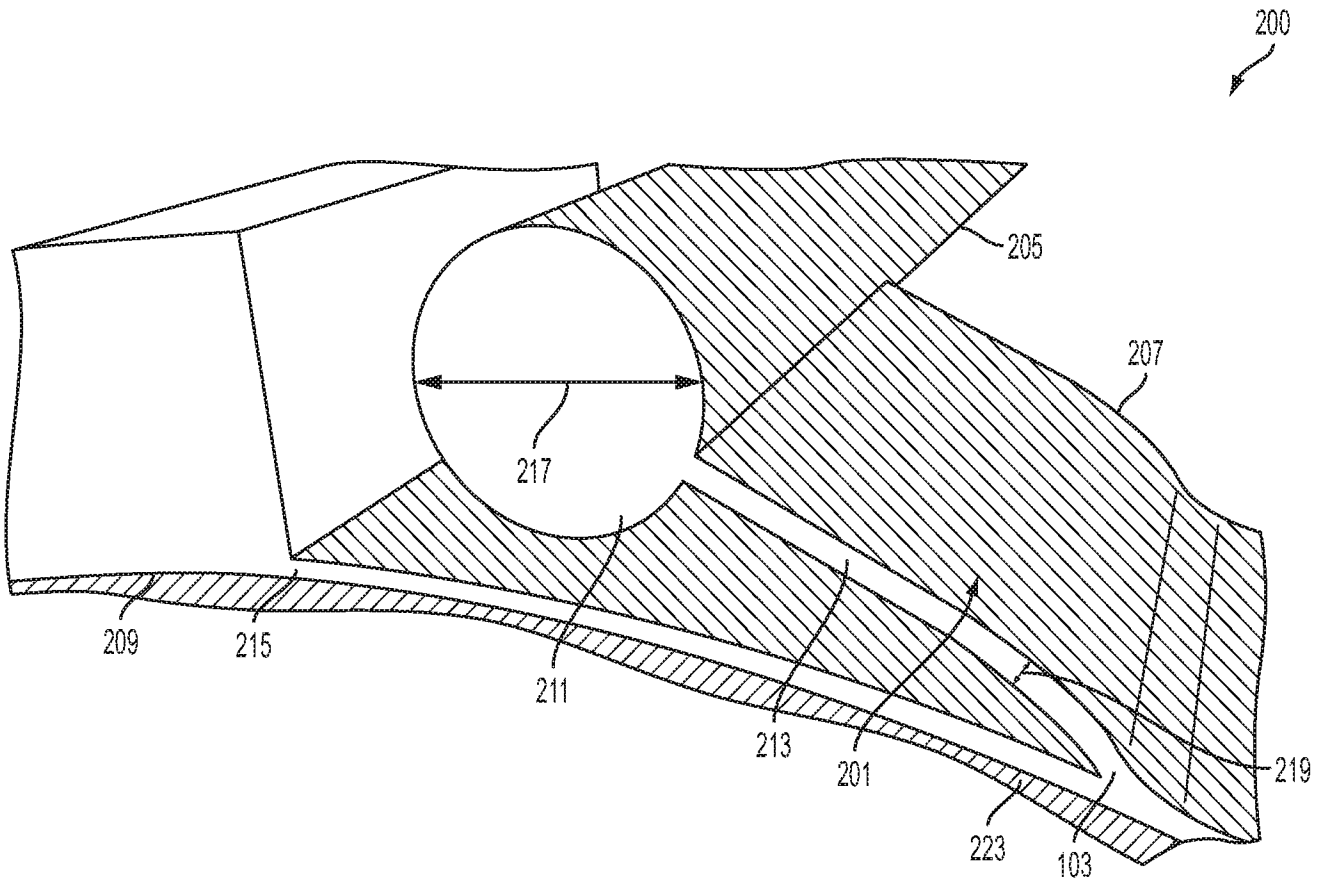
FIG. 2 shows a side diagrammatical exploded perspective view in section of a dampening fluid vapor deposition system in accordance with an exemplary embodiment.

FIG. 2 shows a side diagrammatical exploded perspective view of a dampening fluid vapor deposition system in accordance with an exemplary embodiment. In particular, FIG. 2 shows a dampening fluid vapor deposition system 200. The system 200 includes a dampening fluid manifold 201. The manifold 201 may include a supply chamber 205. The supply chamber 205 may be configured in the shape of a tube, for example. The supply chamber 205 may define an interior 211 for containing fluid such as dampening fluid suitable for ink-based digital lithographic printing.

The manifold 201 may include a supply channel 207. The supply channel 207 may define an interior 213. The interior 213 of the supply channel 207 may communicate with the interior 211 of the supply chamber 205 to enable flow of dampening fluid from the supply chamber 205 to the supply channel 207. The supply chamber 205 may be connected to a dampening fluid supply (not shown) for receiving dampening fluid in the interior 211 of the supply chamber 205. Preferably, a ratio of the cross sectional area of the supply channel 207 to the cross sectional area of the tubular supply chamber 205 is 0.8. The supply channel 207 may be configured to deposit dampening fluid vapor onto a plate surface 209, for example, at opening 103, with uniform dampening fluid concentration, mixture velocity, and temperature. The supply channel 207 extends to include arc walls 221 that continue adjacent the plate surface 209 of an imaging member 223.

For example, a gap 215 between a surface of the plate 209 and the manifold 201 may be 1.735 mm. Gap 215 may be in the range of 1 mm to 3.0 mm, and gap in the range of 1 mm to 1.5 mm is preferred. A diameter 217 of the supply chamber 205 may be 20 mm. A width 219 of the supply channel 207 may be 1.735 mm. A width of the surface of the plate 209 may be 100 mm. It has been found that a width of the printing plate surface may be widened by adjusting manifold dimensions, but maintaining the cross sectional area of the supply channel to the cross sectional area of the tubular supply chamber of 0.8 or less. Further, it has been found that configurations in accordance with embodiments enable uniform concentration and volume far downstream of the manifold exit during vapor deposition, which enables a well-established condensation region for dampening fluid to form by condensing dampening fluid vapor.

Accordingly, systems may be configured for enhanced printing at acceptable process speeds, for example, 500 mm/sec to 2000 mm/sec. Moreover, systems may be configured to print at such speeds while running at desired process widths. For example, systems may be configured to include a 1200 DPI laser system while printing at 2000 mm/sec.

Figure 3:
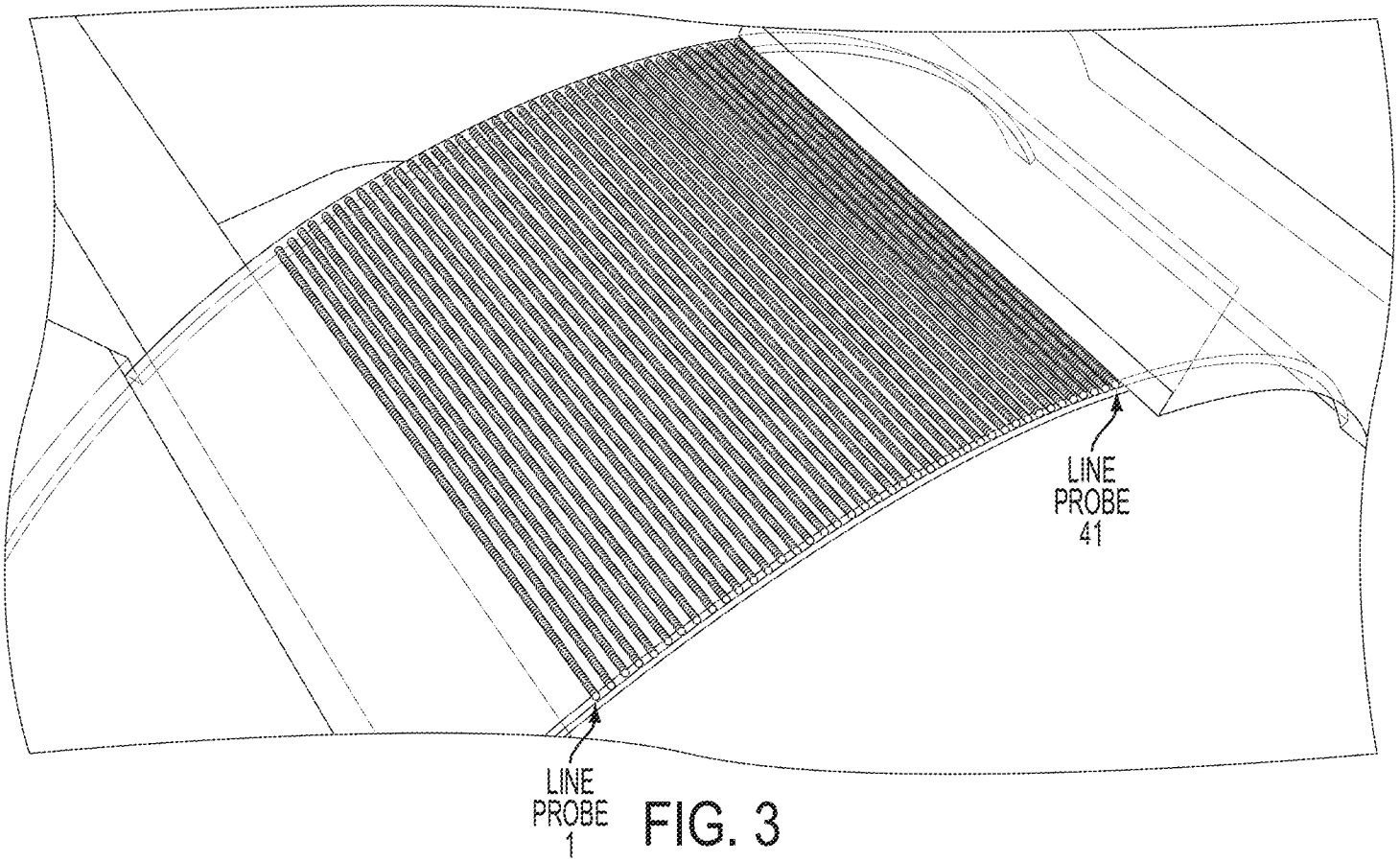
FIG. 3 shows a vapor deposition system geometry computational domain.

FIG. 3 shows a vapor deposition system geometry computational domain. Line probes 1-41 report tangential velocity at 0.5 mm above a plate surface, mass fraction at the surface of the plate, and temperature at the surface of the plate.

Figure 4:
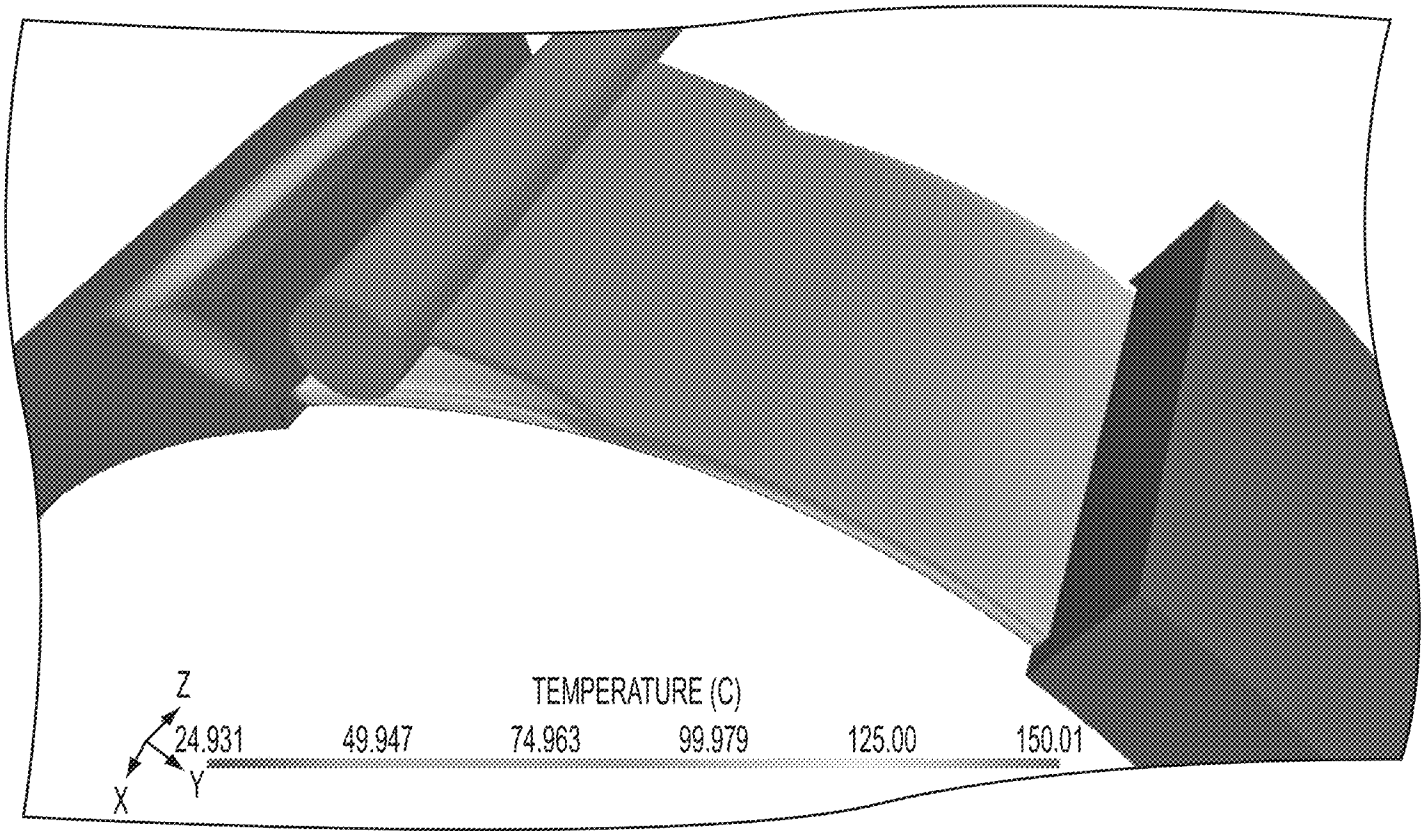
FIG. 4 shows vapor deposition geometry temperature distributions.

FIG. 4 shows vapor deposition system geometry temperature distributions. In particular, FIG. 4 shows that air and D4 vapor are pre-mixed before they enter the manifold with a temperature of 150° C. FIG. 4 shows temperature distribution on an inner surface of the manifold.

Figure 5:
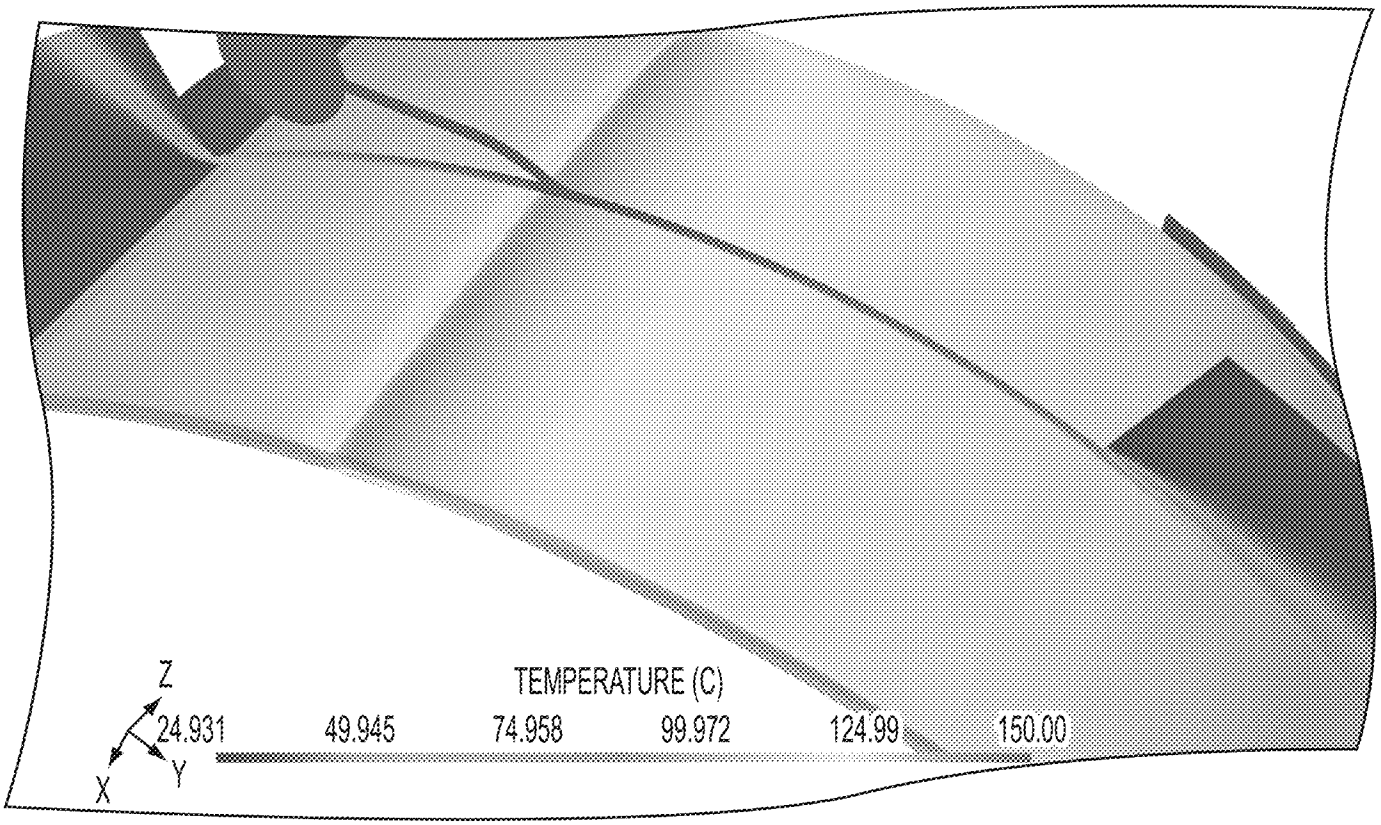
FIG. 5 shows vapor deposition geometry temperature distributions.

FIG. 5 shows a temperature distribution on a surface of a plate and at a cross section through the center of the computational domain. With specified losses at an outer surface of the plate and the drum, the temperature of the plate is substantially high. This may limit an amount of D4 vapor condensing at a surface of the plate. It is of importance to notice the uniformity of the temperature over the width of the plate.

Figure 6:
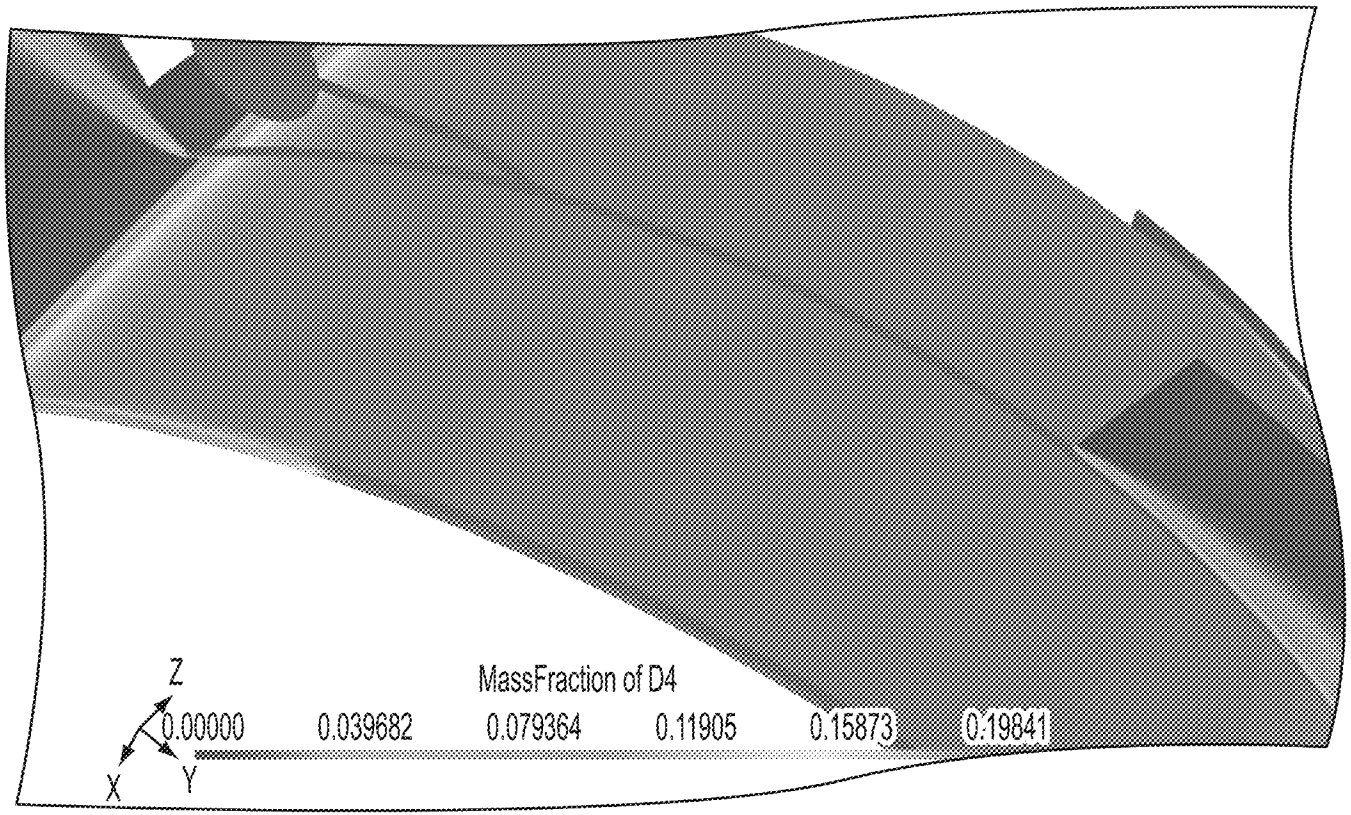
FIG. 6 shows D4 mass fraction distribution on a surface of a plate at a cross section.

FIG. 6 shows D4 mass fraction distribution on a surface of a plate at a cross section through the center of the computational domain. Excellent mass fraction uniformity was obtained with this manifold configuration and pre-mixing.

Figure 7:
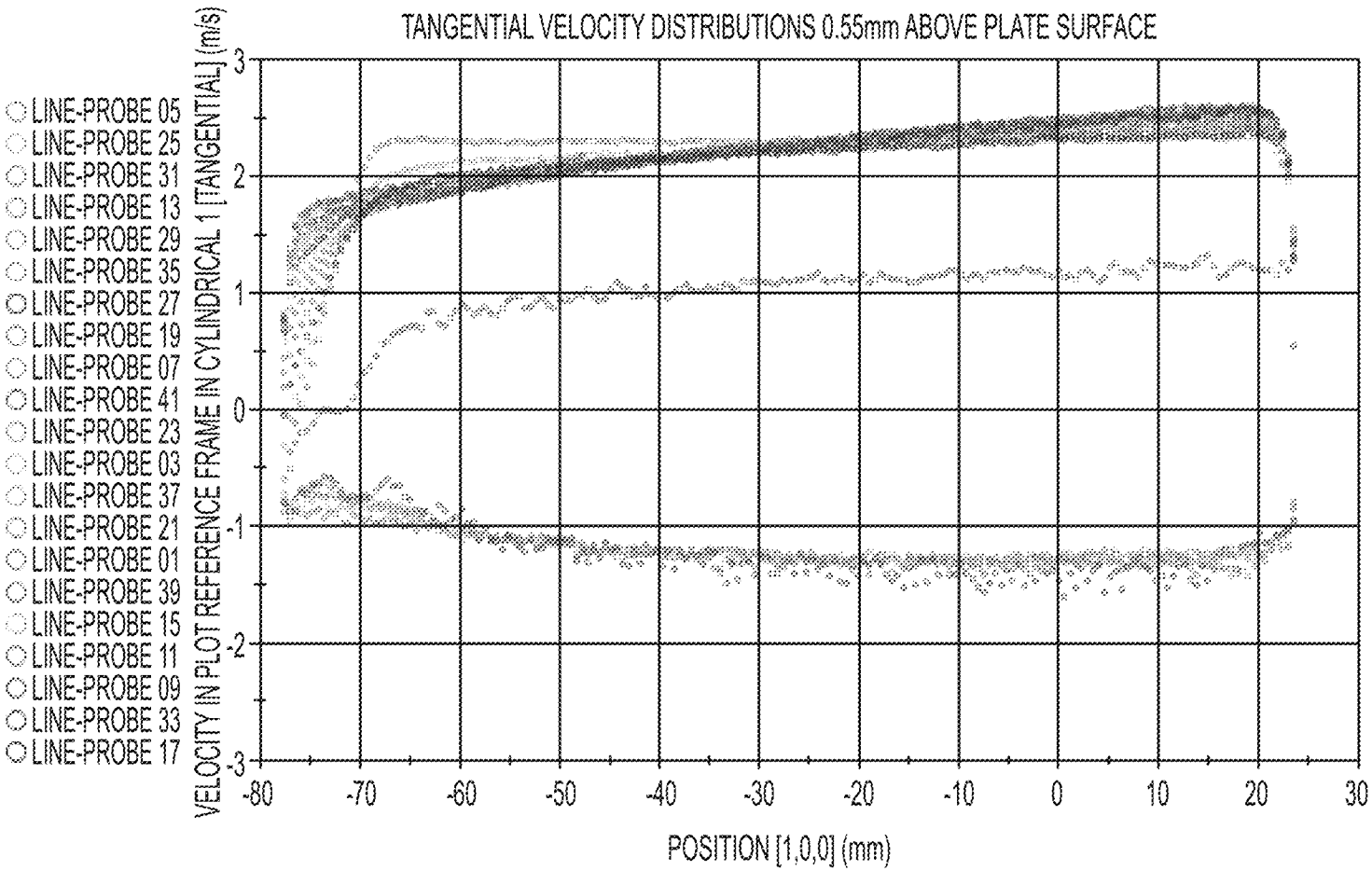
FIG. 7 shows tangential velocity distributions 0.5 mm above a plate surface.

FIG. 7 shows tangential velocity distributions 0.5 mm above a plate surface. In particular, FIG. 7 shows vapor deposition system geometry tangential velocity distribution 0.5 mm above the plate wherein a plate rotational speed is constant at 1000 mm/sec. Good velocity uniformity was achieved with this manifold configuration.

Figure 8:
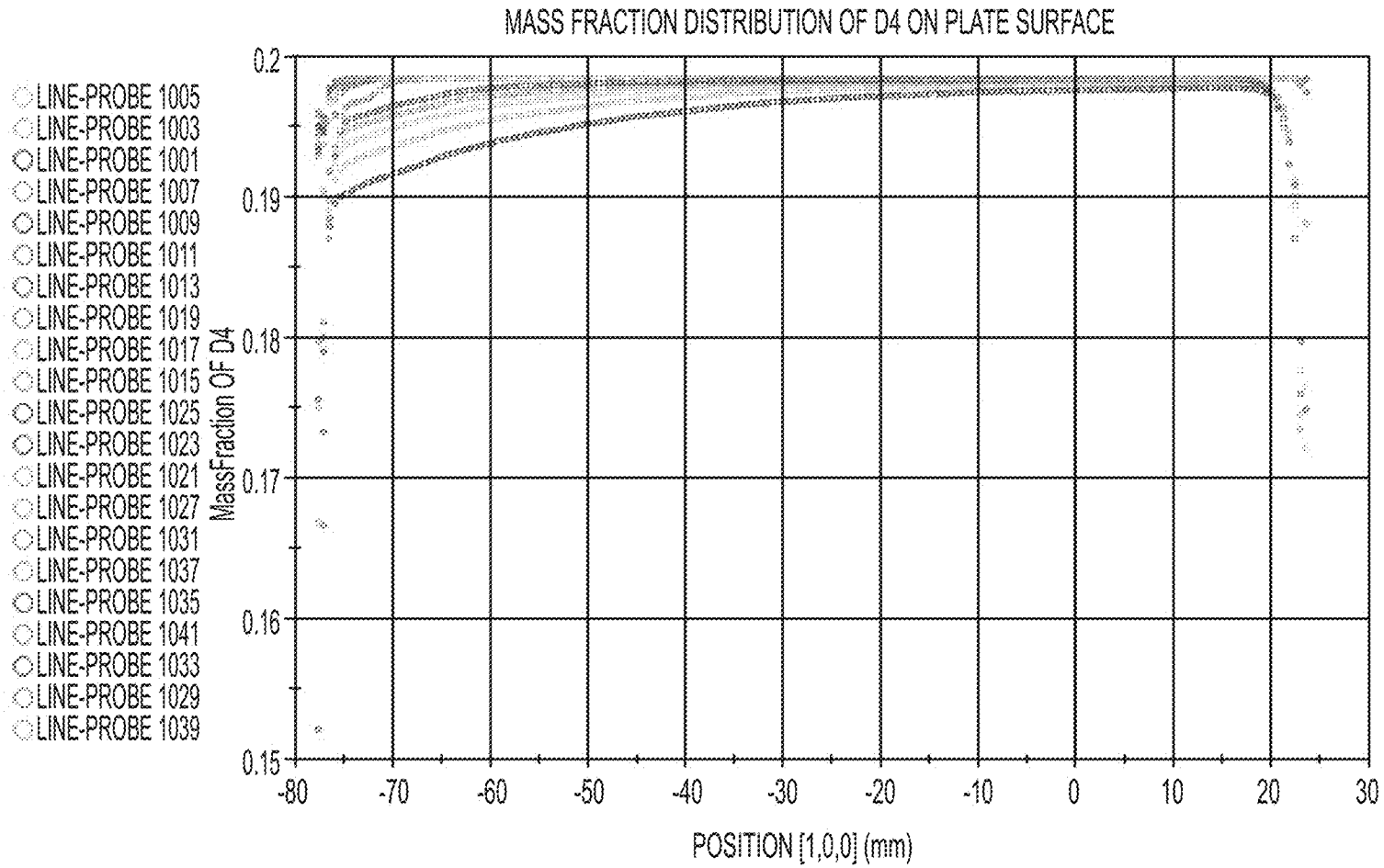
FIG. 8 shows a graph of mass fraction distribution of D4 on a plate surface.

FIG. 8 shows a graph of mass fraction distribution of D4 on a plate surface. In particular, FIG. 8 shows mass fraction of D4 vapor on a plate surface wherein a rotational speed is constant at 1000 mm/sec. Excellent mass fraction distribution was obtained with this manifold configuration and with the air and D4 vapor pre-mixed.

Figure 9:
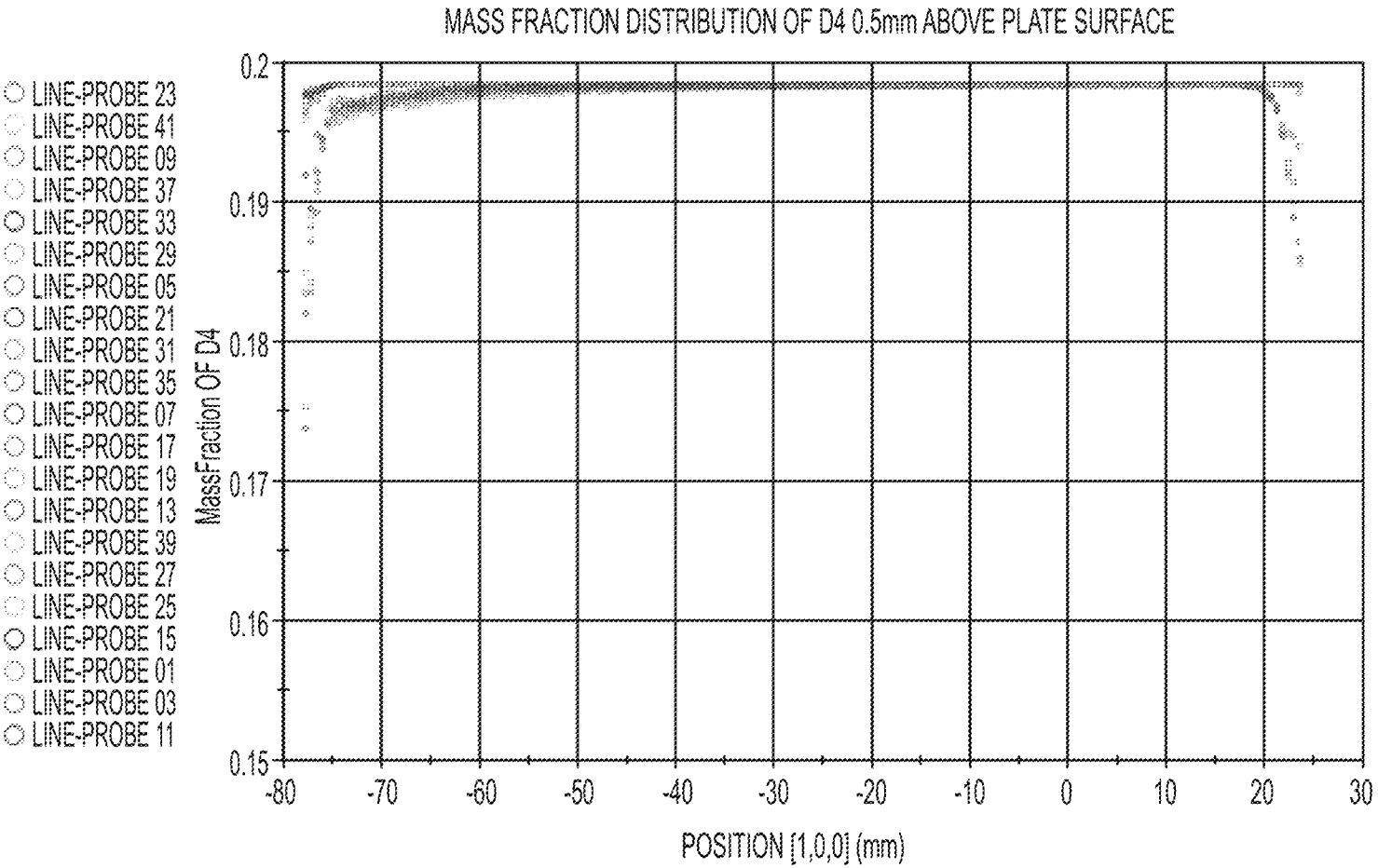
FIG. 9 shows a graph of mass fraction distribution of D4 0.5 mm above a plate surface.

FIG. 9 shows a graph of mass fraction distribution of D4 0.5 mm above a plate surface. In particular, FIG. 9 shows vapor deposition geometry for a mass fraction of D4 0.5 mm above a plate surface wherein a rotation speed is constant at 1000 mm/sec. Excellent mass fraction distribution was obtained with this manifold configuration and with air and D4 vapor pre-mixed.

Figure 10:
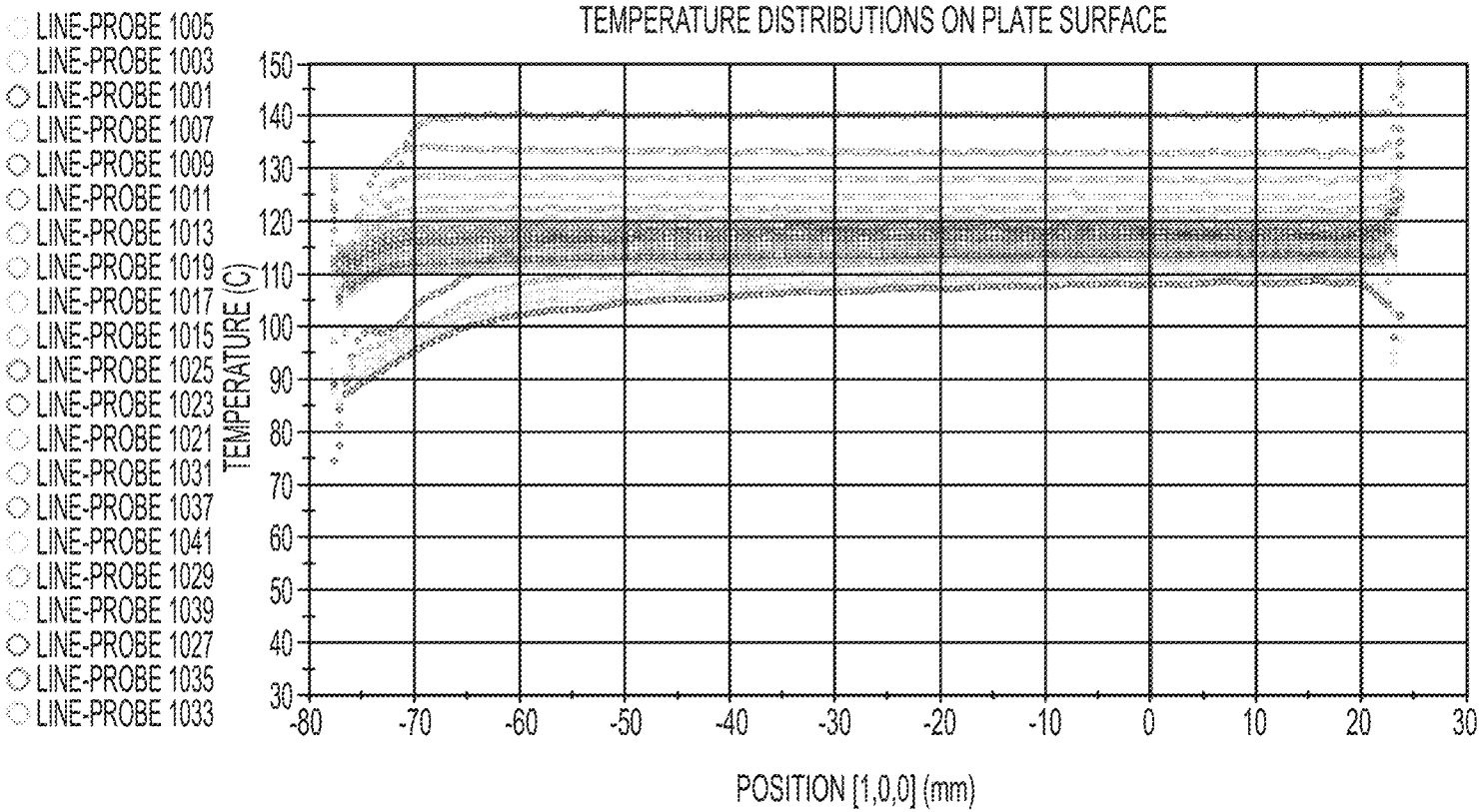
FIG. 10 shows a graph of temperature distributions on a plate surface.

FIG. 10 shows a graph of temperature distributions on a plate surface. In particular, FIG. 10 shows vapor deposition geometry temperature distribution on a plate surface wherein a plate rotational speed is constant at 1000 mm/sec.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An ink-based digital printing dampening fluid delivery system useful for printing with an ink-based digital printing system, the ink-based digital printing system having an imaging member, the system comprising:

a supply chamber having a supply chamber interior;

a supply channel, the supply channel defining a supply channel interior in communication with the supply chamber interior, the supply channel descending towards the imaging member at an angle of 30 degrees or less, the supply channel being configured to deliver fluid vapor onto a surface of the imaging member; and a supply channel outlet configured to enable the supply chamber interior to communicate with the surface of the imaging member, the supply channel outlet being configured to deliver dampening fluid vapor to the surface of the imaging member at an angle of 30 degrees or less by vapor deposition, the supply channel including line probes configured to report tangential velocity above a plate surface, mass fraction at the surface of the plate, and temperature at the surface of the plate.

2. The system of claim 1, comprising:

a manifold gap, the manifold gap being defined by supply channel and the surface of the imaging member.

3. The system of claim 1, wherein the surface of the imaging member comprises a printing area, the printing area having a width, the system comprising:

a supply chamber diameter, the supply chamber being configured to form a tubular shape, the supply chamber cross sectional area being 1.25 times the supply channel cross sectional area or larger.

4. The system of claim 1, comprising:

a manifold gap, the manifold gap being defined by a distance between the supply channel and the surface of the imaging member, the supply channel interior configured to deliver fluid vapor onto a surface of the imaging member having a width substantially equal to the manifold gap.

5. The system of claim 4, wherein the manifold gap is substantially the same upstream and downstream of the supply channel outlet, with respect to a process direction of the imaging member.

6. The system of claim 1, wherein the surface of the imaging member comprises a printing area, the printing area having a width, the system comprising:

a manifold gap, the manifold gap being defined by supply channel and the surface of the imaging member; and a supply chamber diameter, the supply chamber being configured to form a tubular shape, the supply chamber cross sectional area being 1.25 times the supply channel cross sectional area or larger.

7. The system of claim 6, wherein the manifold gap is substantially the same upstream and downstream of the supply channel outlet, with respect to a process direction of the imaging member.

8. The system of claim 1, wherein the supply channel outlet is configured to deliver dampening fluid vapor to the surface of the imaging member at only an angle of 30 degrees or less by vapor deposition.

* * * * *